United States Patent [19]

Man

[11] 3,979,931

[45] Sept. 14, 1976

[54] PADLOCK WITH DOUBLE SHACKLE LOCK

[76] Inventor: Tsui Wai Man, 1535 Star House, Kowloon, Hong Kong

[22] Filed: May 8, 1975

[21] Appl. No.: 575,656

[52] U.S. Cl. ..... 70/38 A; 70/52

[51] Int. Cl.[2] ..... E05B 67/22

[58] Field of Search ..... 70/38 R, 38 A, 38 B, 70/38 C, 52, 53, 39, 25, 2 C

[56] References Cited

UNITED STATES PATENTS

| | | | |
|---|---|---|---|
| 3,068,682 | 12/1962 | Russell | 70/38 A |
| 3,422,644 | 1/1969 | Foote | 70/38 B |
| 3,505,837 | 4/1970 | Armstrong | 70/38 A |
| 3,735,612 | 5/1973 | Popovici | 70/38 A |

*Primary Examiner*—Robert L. Wolfe

*Attorney, Agent, or Firm*—Flehr, Hohbach, Test et. al.

[57] ABSTRACT

A padlock is disclosed in which a U-shaped shackle is mounted in a lock body of laminated metal construction. The heel and toe ends of the shackle are slidably mounted within openings formed in the body. A pair of lock plates are captured for sliding movement within a laminated subassembly in the body. Detents on the lock plates engage notches which are formed on sides of the heel and toe when the shackle is moved to its locked position. A key-operated lock barrel is provided with an operating member which turns a pair of cams to slide the lock plates inwardly and away from their normally locked positions. Springs are mounted within the subassembly for yieldably urging the lock plates apart toward their locked positions.

1 Claim, 4 Drawing Figures

PADLOCK WITH DOUBLE SHACKLE LOCK

BACKGROUND OF THE INVENTION

This invention in general relates to padlocks and in particular relates to padlocks having shackles which are double locked.

Padlocks have previously been provided in which the ends of the shackle are both engaged when the device is locked. Among such previous padlocks are those in which a single plate is rotated into and out of engagement with the heel and toe of the shackle. However, such prior art double shackle lock devices have been relatively complex and expensive in design and construction.

OBJECTS AND SUMMARY OF THE INVENTION

It is a general object of the invention to provide a new and improved padlock of double shackle lock design.

Another object is to provide a padlock of the type described which is relatively simple and inexpensive in design and construction.

Another object is to provide a padlock of the type described which incorporates a pair of sliding lock members adapted to be moved into and out of locking engagement with notches formed on the heel and toe of a shackle under influence of a key-operated lock barrel.

The invention in summary includes a padlock body which is formed with a pair of openings through which the heel and toe portions of a U-shaped shackle are slidably mounted. A pair of lock plates are mounted in side-by-side relationship within the body and are yieldably urged by springs outwardly into normal locking engagement with notches formed in the heel and toe of the shackle. A key-operated lock barrel is mounted in the body and is provided with a rotary operating member. The operating member carries a pair of cams which engage arms formed on the lock plates whereby rotation of the operating member slides the lock plates out of engagement with the notches in the shackle permitting the shackle to be moved in a direction away from the body so that the device is unlocked.

DESCRIPTION OF THE PREFERRED EMBODIMENTS

Figure 1:
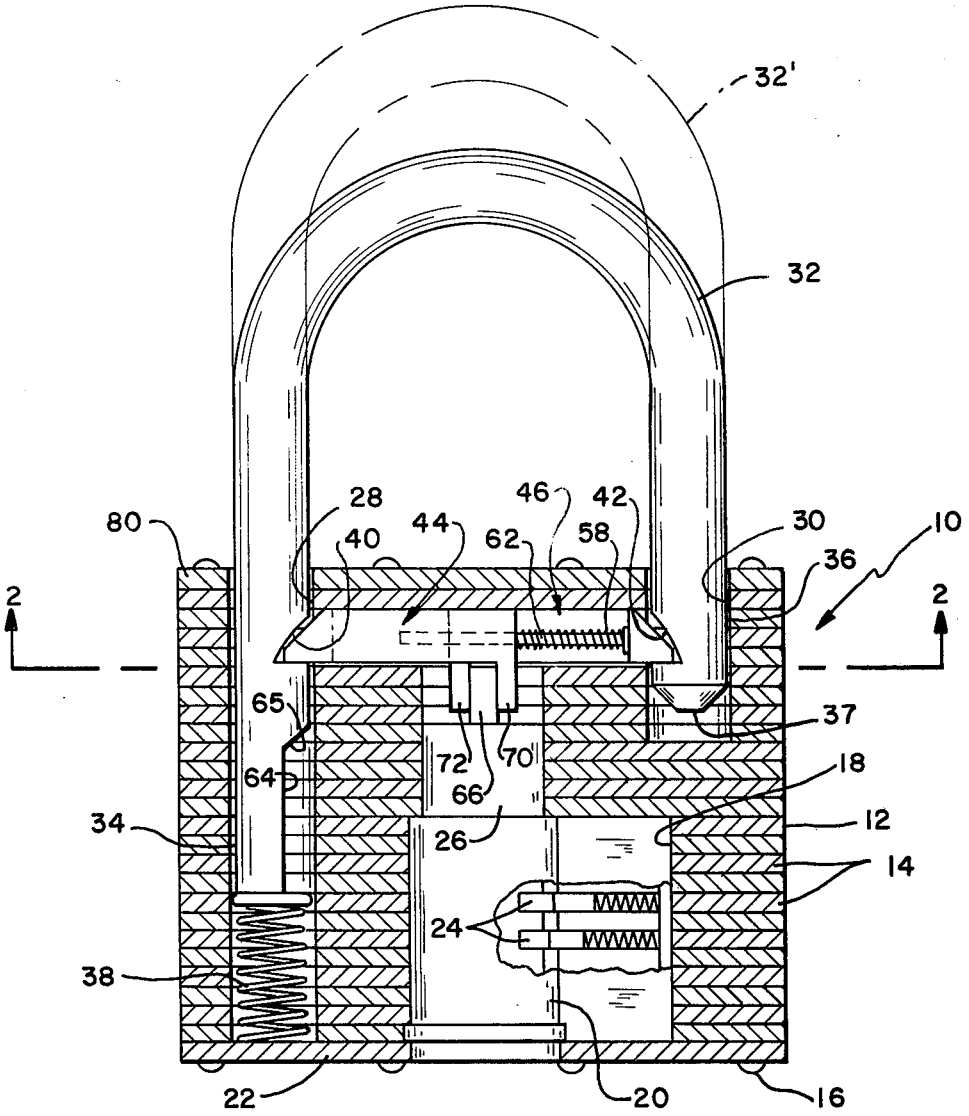
FIG. 1 is an elevational view in section of a laminated padlock incorporating the invention.

In the drawings, FIG. 1 illustrates generally at 10 a padlock of the invention which includes a body 12 of laminated construction. The body is formed of a plurality of thin sectioned metal plates 14 which are secured together in stacked relationship by a plurality of bolts 16 mounted through aligned openings formed in the plates. The plates are also formed with central openings shaped so that the laminated stack defines an internal chamber 18 for confining the lock parts.

A key-operated lock barrel 20 of suitable design is mounted within lock body chamber 18 and is secured therein by means of bottom end plate 22. The lock barrel includes a plurality of tumbler pins 24 which are adapted to be moved radially outwardly when a suitable key is inserted into the barrel for releasing a cylindrical operating member 26 of the barrel for rotation about the longitudinal axis of the padlock.

A pair of spaced-apart openings 28, 30 are formed along parallel axes in the laminated plates of body 12. A U-shaped shackle 32 is formed with heel end 34 and toe end 36 which are mounted for sliding movement in respective body openings. A rounded surface 37 is formed on the lower end of the toe to facilitate inward movement of the shackle, in a manner to be described. The heel end of the shackle extends through a distance beyond the toe end. A compression spring 38 is mounted within the lower end of opening 28 for yieldably urging the shackle in a direction from the locked position illustrated in solid line in FIG. 1 to the unlocked position illustrated in broken line at 32'. A pair of inwardly facing notches 40, 42 are formed on the sides of respective heel and toe ends of the shackle. Each of the notches is formed with a radially extending flat surface together with an upwardly extending arcuate surface.

Figure 2:
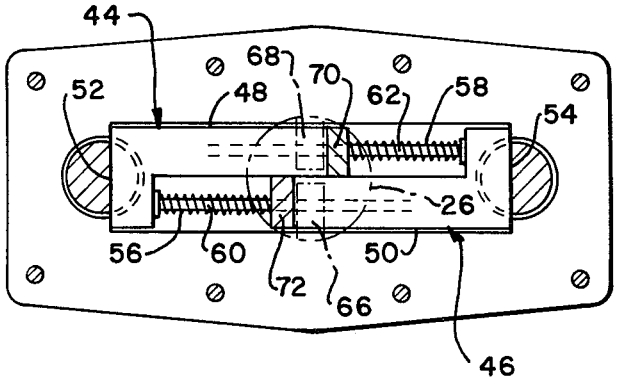
FIG. 2 is a cross-sectional view taken along the line 2—2 of FIG. 1.

A pair of lock plates 44, 46 are mounted within body chamber 18 for sliding movement toward and away from respective heel and toe ends of the shackle. As best shown in FIG. 2, the lock plates each include elongate shafts 48, 50 which carry at opposite ends detents 52, 54. The detents are positioned for locking engagement with respective notches 40 and 42 when the shackle is moved inwardly. A pair of compression springs 56, 58 are provided and each compression spring is mounted between an end of one lock plate shaft and the inner side of the detent of the other lock plate. A pair of guide pins 60, 62 are mounted on the detents coaxially within respective springs, and openings are formed through the ends of each shaft for receiving the guide pins as the lock plates move together. The springs 56 and 58 operate to normally urge the two lock plates apart for carrying the detents into locking engagement with respective notches when the shackle is moved inwardly to its locked position. An additional elongate notch 64 is formed in heel end 34 below notch 40. The lock plate 44 projects within the notch 64 when the shackle is moved to its unlocked position for preventing complete separation of the shackle from the body. A rounded surface 65 is formed at the upper end of notch 64 to inwardly cam lock plate 44 as shackle is moved toward its locked position.

Cam means is provided in body 12 for simultaneously sliding the lock plates out of locking engagement with the shackle notches. The cam means includes a pair of tabs 66, 68 which are mounted for rotation with and extend upwardly from operating member 26 of the lock barrel. Downwardly extending arms 70, 72 are formed on the inner ends of respective lock plate shafts 48 and 50. The facing sides of the arms form cam follower surfaces which are positioned radially outwardly of respective cam tabs 66 and 68 whereby rotation of the operating member causes the tabs to cam against the respective arms and urge the lock plates inwardly toward each other.

Figure 3:
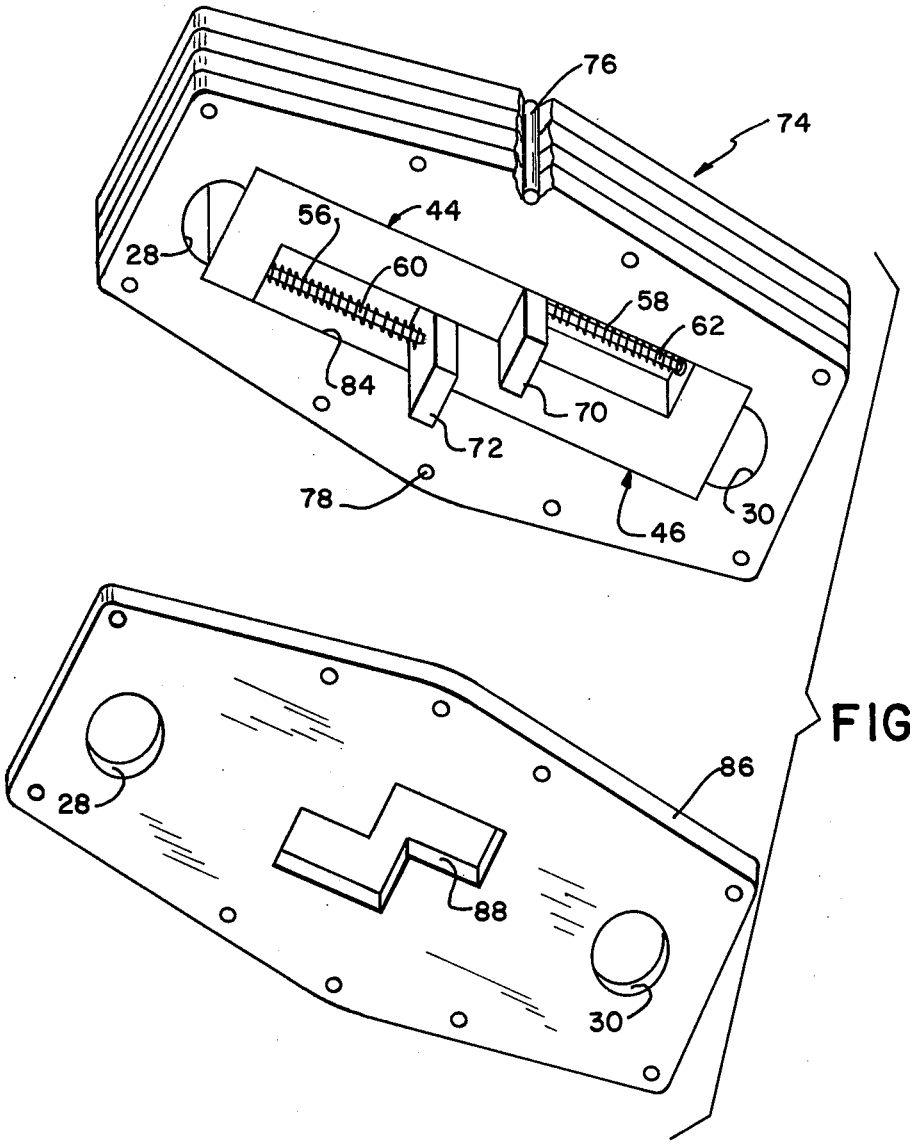
FIG. 3 is a perspective, partially exploded view of a subassembly of the padlock.
Figure 4:
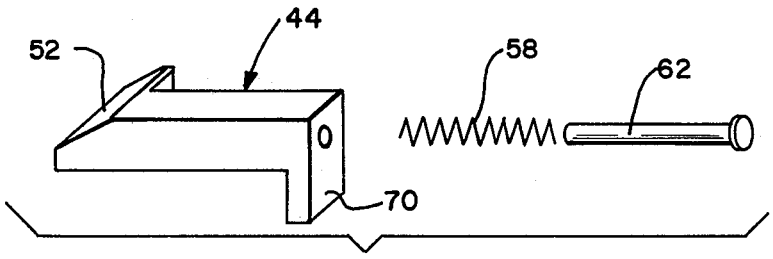
FIG. 4 is a perspective view of elements of one of the lock plates incorporated into the subassembly of FIG. 3.

A subassembly 74 of the padlock comprises five of the flat laminated plates 82–86 which are secured together in stacked relationship by a pair of bolts 76, 78. The subassembly 74 in turn is secured on the upper portion of the body by a top end plate 80. The three middle plates 82 of the subassembly are formed with central openings which define a cavity 84 for receiving the lock plates 44 and 46, as shown in FIG. 3. The lock plates and associated springs and guide pins are captured within the cavity by the upper plate 85 and by the lower plate 86. The plate 86 is formed with an S-shaped opening 88 through which lock plate arms 70 and 72 project downwardly for engagement with the cam tabs 66 and 68. The subassembly 74 greatly facilitates the separate assembly of the lock plate elements, and at the same time securely holds these elements in place both during final assembly and when in the padlock.

In operation, it will be assumed that initially the shackle of padlock 10 is in its unlocked position as illustrated at 32' in FIG. 1. For locking the padlock, the shackle is manually moved inwardly into the body against the force of spring 38. At the same time the combined forces of springs 56 and 58 are urging the lock plates apart. As the shackle is moved inwardly, the rounded end of toe 36 cams against detent 54 for moving lock plate 46 inwardly to permit the toe to clear the detent. Thereafter, lock plate 46 is urged outwardly by the springs to carry detent 54 into locking engagement with notch 42. At the same time, lock plate 44 is first cammed inwardly by surface 65 of notch 64, and thereafter is urged outwardly by the springs to carry detent 52 into locking engagement with notch 40 of the heel end. For unlocking the device, the key is inserted into lock barrel 20 to move the tumbler pins outwardly and release operating member 26. The key is then turned for rotating the operating member and cam tabs 66 and 68. The cam tabs bear against and move apart arms 70 and 72, thereby moving the lock plates inwardly to retract the detents from the notches. Spring 38 then acts to urge shackle outwardly toward its unlocked position.

From the foregoing it will be realized that there has been provided herein a new and improved padlock with a double shackle lock feature. The padlock of the invention is relatively small in size. The provision of providing sliding lock plates which simultaneously engage both the heel and toe portions of the shackle provides a compound locking force which materially increases the ability of the padlock to resist forcing of the padlock such as by a crow bar, jack or other similar device.

While the embodiments herein are at present considered to be preferred, it is understood that numerous variations and modifications may be made therein by those skilled in the art and it is intended to cover in the appended claims all such variations and modifications as fall within the true spirit and scope of the invention.

What is claimed is:

1. A padlock comprising the combination of a body having a pair of spaced openings, said body comprising a plurality of flat plates secured together to form a laminated construction, with a first group of the flat plates being formed with central openings which cooperate to define a cavity, and with a second group of the flat plates being mounted on opposite sides of said first group of plates for closing the cavity, fastener means for securing together said first and second groups of plates to form a sub-assembly which can be assembled separately from the remaining elements of the padlock, end plate means for securing said sub-assembly on the body, a U-shaped shackle having heel and toe ends slidably mounted for movement in respective ones of the spaced openings between a locked position wherein the ends are enclosed within the body and an unlocked position wherein the toe end is separated from the body, the sides of the heel and toe being formed with respective first and second notches, a key-operated lock barrel having an operating member mounted for selective rotation about an axis under the influence of a key, first and second lock plates captured within the closed cavity of the sub-assembly by the second group of plates to prevent unintended separation therefrom, with the lock plates being slidable within the cavity toward and away from respective heel and toe ends of the shackle, spring means for yieldably urging the lock plates into locking engagement with respective notches when the shackle ends are in the locked position, and cam means for simultaneously moving the lock plates out of engagement with respective notches responsive to rotation of the operating member, said cam means including a pair of cams mounted on opposite sides of the axis for rotation with the operating member, and means forming cam follower surfaces on the first and second lock plates, said follower surfaces being positioned in register with the cams whereby rotation of the cams about the axis moves the cams against respective follower surfaces for linearly moving the locked plates outwardly toward respective notches.

* * * * *